United States Patent [19]

Gassmann

[11] Patent Number: 4,733,487

[45] Date of Patent: Mar. 29, 1988

[54] DISPLAY UNIT

[76] Inventor: Gerhard G. Gassmann, Vogelsang 5, D-7266 Neuweiler 2, Fed. Rep. of Germany

[21] Appl. No.: 910,373

[22] Filed: Sep. 22, 1986

[30] Foreign Application Priority Data

Sep. 20, 1985 [DE] Fed. Rep. of Germany ..... 3533575

[51] Int. Cl.[4] ..... G09F 11/12

[52] U.S. Cl. ..... 40/472; 340/764; 340/815.27; 40/447

[58] Field of Search ..... 40/447, 446, 450, 451, 40/472, 512; 340/764, 783, 755, 815.04, 815.27

[56] References Cited

U.S. PATENT DOCUMENTS

| | | | |
|---|---|---|---|
| 3,600,834 | 8/1971 | Stamer | 40/472 |
| 3,605,302 | 9/1971 | Muller | 40/472 |
| 4,110,922 | 9/1978 | Leeman-Dittmann | 40/447 |
| 4,533,912 | 8/1985 | Gal et al. | 340/764 |

FOREIGN PATENT DOCUMENTS

| | | | |
|---|---|---|---|
| 3134356 | 3/1983 | Fed. Rep. of Germany . | |
| 8403981 | 10/1984 | PCT Int'l Appl. . | |
| 8503794 | 8/1985 | PCT Int'l Appl. . | |
| 8504506 | 10/1985 | PCT Int'l Appl. | 340/764 |

*Primary Examiner*—John J. Wilson

*Assistant Examiner*—Cary E. Stone

*Attorney, Agent, or Firm*—Thomas W. Speckman; Ann W. Speckman

[57] ABSTRACT

The invention relates to a display unit in which characters, symbols or pictures are created in matrices composed of lines and columns by the presence or absence of graphic display elements, and the display elements are moved into a visible or invisible position simultaneously in the one direction, such as columns, and subsequently in the other direction, such as lines, by a composing unit activated, for example, electromagnetically, by a data processing unit. The display elements are moved past the composing unit, and when, during this movement, the next axis (column or line) to be set has reached a setting position, an impulse is sent back to the data processing unit releasing the activation of the composing unit. With a transport belt having display elements which are only partially punched out, the display elements can be moved by the composing unit in a way that they will be positioned in front of or behind a separating strip during subsequent rotation of the transport belt. Since the transport belt with its display elements has a contrasting color in relation to the separating strips, the characters created by the arrangement of display elements and separating strips are clearly visible.

11 Claims, 11 Drawing Figures

DISPLAY UNIT

BACKGROUND OF THE INVENTION

1. Field of the Invention

This invention relates to a display unit in which characters, symbols or pictures may be created by the use of lines and columns of graphic display elements moved into visible or invisible positions to create the desired image.

2. Description of the Prior Art

A display unit of this type is taught in German Patent Document DE-OS 31 34 356. This display unit, however, has the disadvantage that it requires two transport belts featuring substantial elasticity in the area where they are bent around the transport rollers in order to form a variable bending radius. This high degree of elasticity required in transport belts is highly undesirable, since they tend to sag due to lack of tension. Also, in the described display unit, spheres are used for display elements.

Using 5×7 matrices, 35 spheres are needed for each letter and, with 30 visible characters, and at least 40 more invisible characters (backside and roller area), altogether 70 characters are required. This means that 70×35=2450 spheres are required. Such a large number of spheres translates into a large expense for material and also for labor when it comes to inserting the spheres. The required number (2450) of spheres weigh a lot in relation to the transport belt and this unit in turn requires a much stronger belt.

International Patent Specification WO 84/03981 describes a different type of display unit. This unit also features two transport belts which, however, are not mounted above each other but are guided separately over two transport rollers each. The expenditure in this case is even greater than with the previously described prior art display unit.

There are also display units featuring rotating display elements which are arranged in a display area and do not form a display through their presence or absence, but by rotating at 180°. They may have a white surface on one side and a black surface on the other.

This type of display unit is more complicated and expensive than the above described display units because each of these numerous display elements has to be mounted on a rotating axle, requiring high quality bearings which should not be susceptible to corrosion due to condensation. In addition, the cost of manufacturing and assembling these units is quite high.

SUMMARY OF THE INVENTION

It is a purpose of this invention to overcome these disadvantages and to provide a low cost display unit, thus avoiding high costs for material and labor, and to provide a display unit suitable for large scale application in those sectors where this type of display unit has not yet been used for financial reasons.

According to the present invention, the disadvantages of prior art display units are overcome by the fact that display elements comprise partially punched out, cut out, or etched out portions of a transport belt which, in relation to the moving direction, are connected with the transport belt on the side of the display elements below, or preferably above, the cutout portions of the display elements. According to the characters desired to be displayed in the display area, the display elements are arranged in visible or invisible positions either in front of or behind separating strips. The composing unit moves the display elements in a way that they are positioned either in front of or behind separating strips when the transport belt is in motion. The transport belt with the display elements has a contrasting color in relation to the separating strips.

The apparatus of this invention offers an extremely important advantage for mass produced display units which consists in a low price for wearing parts. These parts can easily be replaced by a non-professional in cases where they show wear and tear. Replacing the transport belt with its display elements in this invention is no more complicated than replacing the ink ribbon in a typewriter. Since the display elements and the transport belt are one unit, no additional expense or labor is require in order to replace display elements at the same time.

Also, due to the low cost of individual display elements it is possible to use a matrix having a higher resolution such as 7×9 or 9×11 for the characters to be displayed instead of a 5×7 matrix, without any considerable extra cost. This also provides a considerable advantage when it comes to quality since descending portions of lower case letters such as g, j, q, etc., can be displayed.

Even "proportional spacing" is possible without any considerable additional cost. Proportional spacing means that less space is provided for the character "I" than for the character "W".

This feature considerably expands the application for this invention because higher resolution and proportional spacing enable the display of characters such as Arabic letters at a reasonable cost.

It is another important advantage of the display unit of the present invention that the displayed image can be made visible from both the front and the back of the display unit without requiring two composing units.

Finally, it should be mentioned that the ophthalmo-physiological requirement, which demands that the surface area of the display elements should be as large as possible in relation to the surrounding area, can be easily satisfied since the display elements can be square in the described display unit with a very short distance between display elements. Spheres, which appear as circles when viewed from the front, naturally have a smaller surface area, even when the distance between spheres remains the same.

Even with rather long display units no sagging of the transport belt occurs since some display elements are supported by the separating strips, which serve as a guide for the transport belt and provide additional support for its weight.

Further embodiments are described below in the claims and the description of preferred embodiments.

BRIEF DESCRIPTION OF THE DRAWINGS

The invention is described in detail by means of preferred embodiments illustrated in the following drawings, in which.

DESCRIPTION OF PREFERRED EMBODIMENTS

Figure 1A:
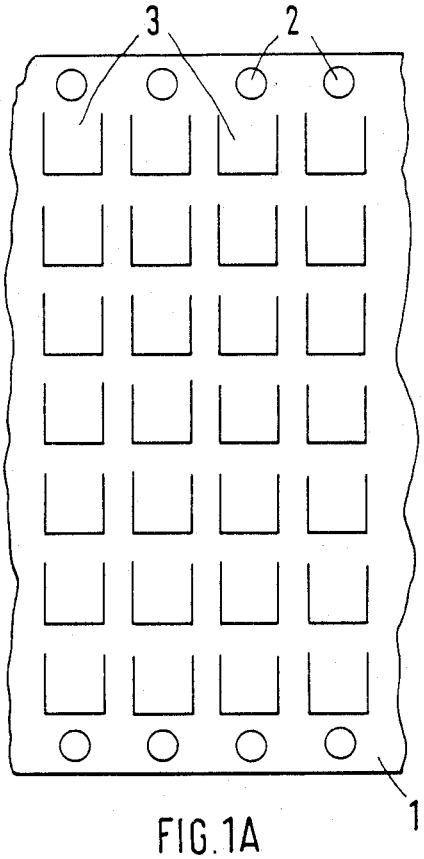
FIG. 1*a* shows a front view of part of a transport belt with rectangular display elements connected thereto.

FIG. 1*a* shows a section of transport belt 1 used in the present invention with feed holes 2 for engagement in pin feed rollers and a plurality of individual display elements 3 cut out on three sides which remain connected to the transport belt at their fourth side (shown as the top in FIG. 1*a*), thus forming an entity with the belt. The relation between display elements and the surrounding area is better in this embodiment than in the embodiment shown in FIG. 1*b*, which shows an embodiment wherein the display elements are spherical and remain connected on top to the transport belt over an arc of approximately 60°. The only advantage this modification provides is that a simpler punching tool may be used.

Figure 1B:
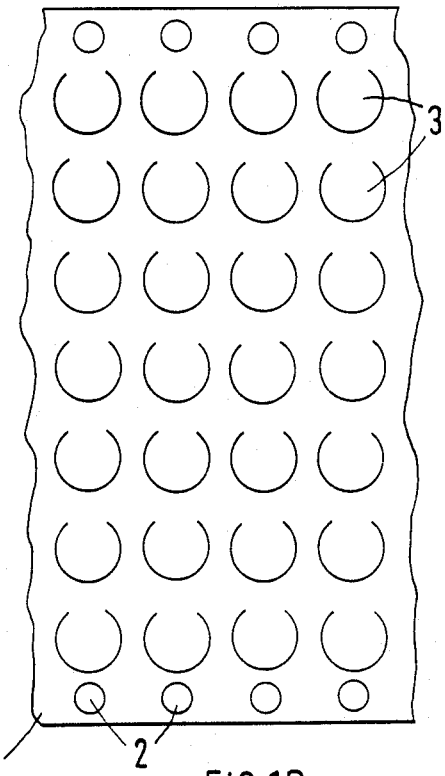
FIG. 1*b* shows a front view of another embodiment wherein the display elements are spherical.

In both FIGS. 1*a* and 1*b*, only four vertical columns and seven lines each are shown. If characters are to be displayed in a 5×7 matrix, 5 columns are required to display one character. Since the cost per display element is extremely low for the display unit of the present invention, it is recommended not to provide letter spacing between the display elements in a vertical direction, for example after five columns comprising a matrix, but to arrange the display elements continuously with the same intervals between display elements. Higher quality "proportional spacing" can thus be used instead of a typeface created by separated matrix display. This makes the typeface much easier to read. With traditional display units proportional spacing has rarely been used so far because of financial reasons. The number of lines and therefore the vertical resolution can be greater than shown in the embodiments of FIGS. 1*a* and 1*b* without a considerable cost increase.

Figure 2:
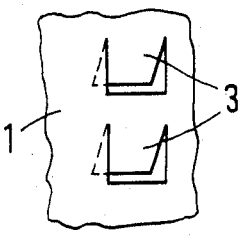
FIG. 2 shows a back view of a section of a transport belt with display elements bent backwardly.

FIG. 2 shows another section of transport belt 1 with two display elements 3 which are bent out of the plane of transport belt 1.

Figure 3:
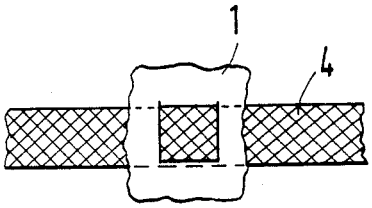
FIG. 3 shows a front view of a display element behind the corrsponding separating strip.

FIG. 3 shows a section of a transport belt wherein the display element is positioned behind the corresponding separating strip 4. Separating strip 4 has a contrasting color in relation to transport belt 1.

Figures 4, 5, 6:
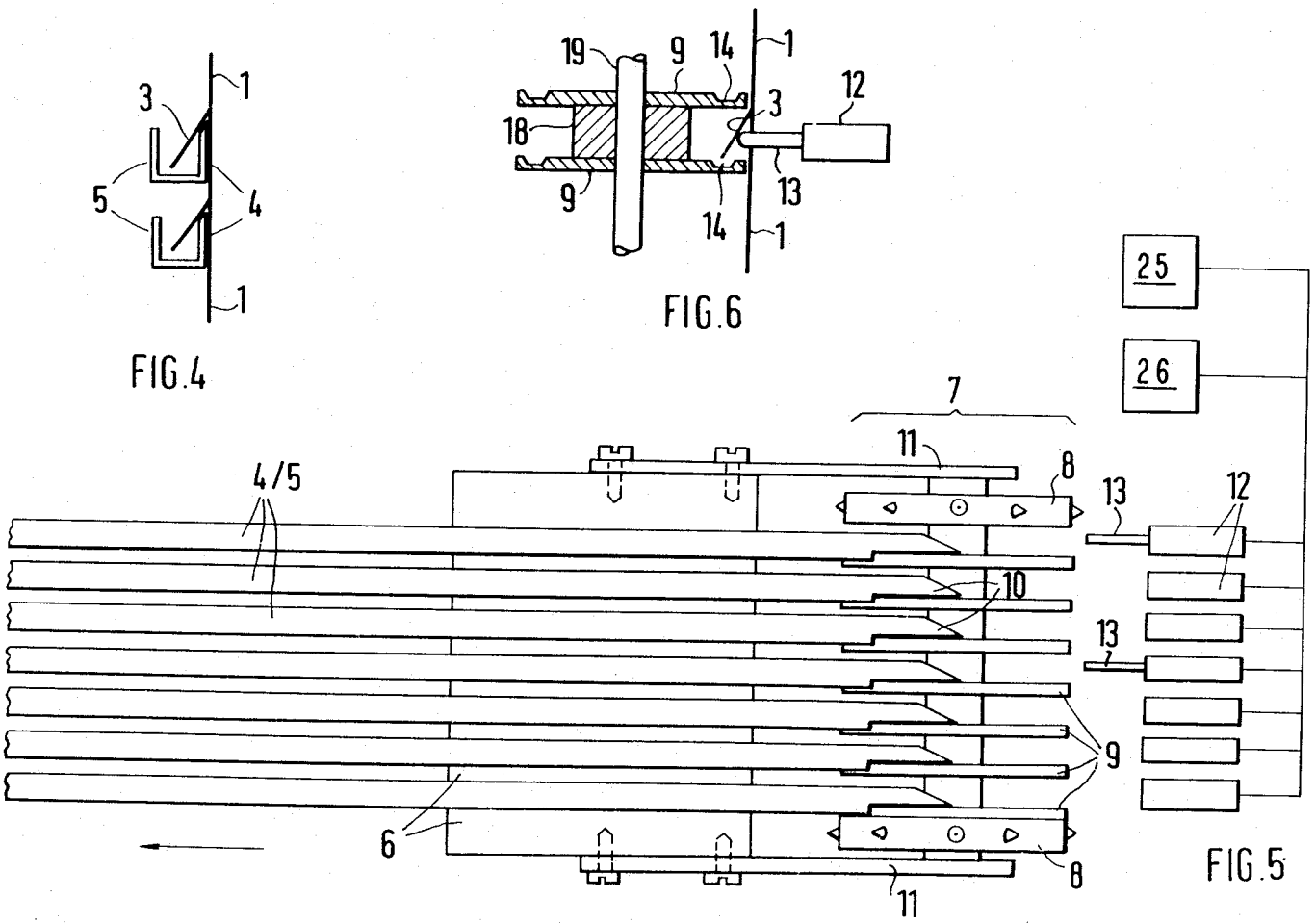
FIG. 4 shows a side view of a transport belt with its display elements in an invisible position behind separating strips.
FIG. 5 shows a front view of a display unit roller assembly and frame without a transport belt.
FIG. 6 shows a partially cross-sectional side view of supporting disks and a composing unit interacting with a display element.

FIG. 4 show a side view of two display elements 3 and two separating strips 4, which are formed in this example by one side of U-shaped channels 5, as well as a section of transport belt 1. The front sides of U-shaped channels 5 serving as separating strips 4 are beveled at their upper surfaces at an angle of about 30° to about 45° in order to provide a support surface at this angle for display elements 3.

FIG. 5 shows the right frontal part of the display unit apparatus and its framework without transport belt 1. In this figure, separating strips 4 are provided as the front sides of U-shaped channels 5. U-shaped channels 5 and bearing brackets 11 are mounted to the frame 6 at the right-hand side of the rack. Right transport roller assembly 7 comprises pin feed rollers 8 and supporting disks 9. These supporting disks support the transport belt between the display elements. Pointed ends 10 of separating strips 4 engage between supporting disks 9 of the right transport roller assembly 7. Bearing brackets 11 may have ball bearings for the transport roller. They are movable toward the display surface and are adjustable in the longitudinal direction of the display surface, so that the distance between both transport rollers can be reduced to mount the transport belt. Magnetic elements 12 of a composing unit are shown schematically with pins 13 that are movable when magnetically activated. With the transport belt in place, these pins can displace individual display elements inwardly between supporting disks 9. The display elements remain in this position until the pointed ends 10 of separating strips 4 are passed and are then positioned behind the separating strips during continued transportation. Only two of the seven magnetically activated pins are shown in FIG. 5 for schematic purposes. The arrow in the lower part of FIG. 5 indicates the direction in which the transport belt moves. The left transport roller assembly, which is not shown, is an exact mirror image of the right side except for the composing unit and the pointed ends that are not shown. Here, too, the U-shaped channels guide the display elements to approximately the center of the roller (as viewed from the front). Further details are described by means of the following figures.

FIG. 6 shows how a display element 3 is pushed inwardly between supporting disks 9 by magnetically activated pin 13 of magnetic composing unit 12. Supporting disks 9 are separated from each other by spacers 18. Both supporting disks and spacers are provided on shaft 19 of the transport roller assembly. The supporting disks are shown here in a cross-sectional view showing grooves 14 along the edge of the disks into which the lower edge of display elements 3 may be pushed. FIG. 6 shows the magnetic pin displaced toward transport belt 1. When the pin is subsequently withdrawn, the display element remains in the groove. As the transport roller assembly rotates, this display element is then positioned behind the corresponding separating strip by the pointed ends 10 of separating strips after about a 90° rotation of the roller assembly. When the pin is not activated to contact the display element, the display element remains in front of the groove edge of the supporting disk and is guided in front of the corresponding separating strip by pointed end 10 of the corresponding separating strip after further transport. An important feature for this method of display unit operation is that the upper edges of the supporting disks are higher than the lower edges of the display elements.

The material best suited for the transport belt with its display elements is a glass-fiber reinforced fabric laminated on both sides with a thin plastic film. This material has an extremely high tensile strength, it can be punched easily, the belt itself and the display elements are flexible, and the display elements can be bent far enough by the magnetically activated pins to locate in the grooves. Excessive wear of feed holes 2 in transport belt 1 occurs only after prolonged use. The ends of the transport belt may be connected by sewing or gluing to form a continuous loop. The desired color may be easily provided by the color of the plastic film.

In order to display text also at the back of the display unit with a single composing unit provided at the right-hand roller assembly, a further embodiment of the present invention features a left transport roller assembly with supporting disks having grooves and higher supporting disk edges than the lower edges of the display elements. The left ends of the separating strips with their beveled top edges guide the display elements behind them into the grooves of these supporting disks, and the display elements located in front of the corresponding separating strips are guided in front of the front edge of the supporting disks. This maintains the visible position or the invisible position, respectively, of the display elements within the area of the left roller assembly and thus maintains the display of characters. The separating strips on the backside of the display unit have the same pointed ends 10 at the left transport roller assembly as the separating strips on the front side of the display unit at the right-hand roller assembly, as shown in FIG. 5. Just as on the illustrated display unit, the pointed ends of the separating strips position the display elements in front of or behind the separating strips provided on the backside of the display unit.

Since only the right-hand transport roller assembly needs to be rotated to provide movement of the transport belt, the separating strips on the front side of the display unit can be connected to the separating strips on the backside of the display unit by strips bent in a circular shape which engage between the supporting disks. This also enables the display of characters to be provided on the backside of the unit. In this embodiment, the top edges of the supporting disks have to be lower than the lower edges of the display elements.

At the end of the separating strips on the back of the display unit are guides which displace all display elements back into the plane of the transport belt. Upon reaching the right-hand roller assembly, all display elements are then positioned in front of the front edges of the supporting disks. The display elements are then in the defined starting position from which they may be displaced by the pins of the composing unit into the grooves of the supporting disks.

Figure 7:
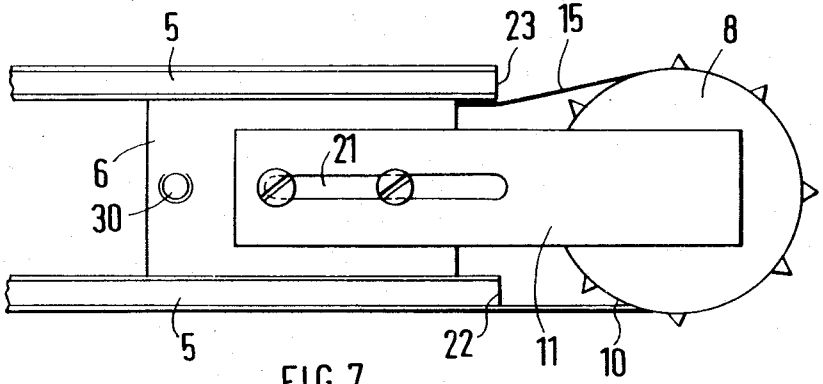
FIG. 7 shows a top view of the display unit roller assembly and frame of FIG. 5.

FIG. 7 shows a top view of the right-hand part of the display unit without a transport belt. Identical parts have the same numbers as shown in the previous figures. This figure also shows ends 22 of the U-shaped channels on the front side of the display unit. Separating strips 4, in this case the front surfaces of U-shaped channels 5, extend beyond end 22 to form the pointed ends 10. The U-shaped channels 5 on the backside of the display unit have end 23. One side of U-shaped channels 5 on the back of the display unit holds guide 15 which guides all display elements of the transport belt (not shown in this figure), to the starting position in front of the front edges of the supporting disks. The supporting disks have the same diameter as pin feed roller 8 which covers the disks in this figure. FIG. 7 also shows slot 21 of bearing bracket 11 by means of which the bearing bracket can be adjusted. Just like the U-shaped channels, the bearing bracket is mounted to right frame 6 of the display unit. Threaded bore 30 in frame 6 is provided to mount a large U-shaped channel not shown in this figure, which may form an upper part of a housing covering the rack.

The only disadvantage of a dual sided display unit with only one composing unit is the time lag between the display on the back in relation to the display on the front. If this disadvantage seems unacceptable, a second composing unit may be provided at the left-hand roller. This additional expense is still considerably lower than the use of two display units as is required with other systems.

In the previously described arrangement, the display unit works as a "passive display". In other words, it is non-luminous and has to be illuminated with light from the surrounding area or daylight. If the display unit of the present invention is to be used as an "active display", a different type of separating strips may be used. The separating strips are not provided by the front sides of U-shaped channels, but are provided by the front side of a solid display board which has grooves to receive and retain the display elements in an invisible position.

Figure 8:
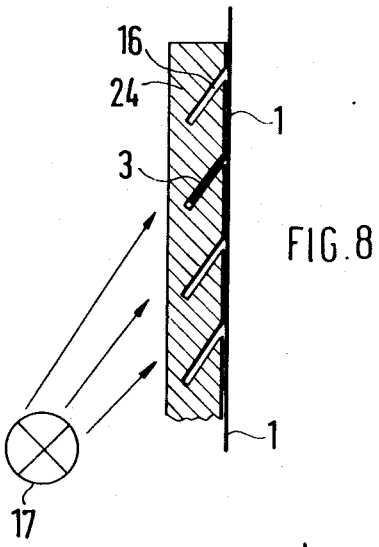
FIG. 8 shows a cross-sectional side view of another embodiment wherein a display board with grooves is provided in the place of separating strips.

FIG. 8 shows a cross section of such a solid display board 24 and transport belt 1. In this embodiment, separating strips 4 are provided by parts of the front side of display board 24 between grooves 16. FIG. 8 shows a display element 3 of transport belt 1 resting in the second groove 16 from the top. Viewed from the front of the display unit, the display element is invisible in this position and separating strip 4 with its contrasting color is visible. If the display unit itself is to be luminous, this display board must comprise diffuse, yet transparent and bright plastic material. Lighting is preferably provided at an angle to and from below the display unit, as shown in FIG. 8 at light source 17. Light from light source 17 reaches the front surface of the display board when the display element is in the invisible position. If, however, the display element is positioned in front of the display board, it remains dark if the display elements are not transparent. A display unit of this type can still operate as a passive display unit during daylight.

In order to guide the display elements into the grooves of the display board, it is preferable to continue providing thin separating strips in the area of the composing unit. These strips may be connected to the front of the display board. The display board may be provided with a cone-shaped enlargement of the grooves at its beginning which extends far enough to ensure that the display elements approaching from behind the thin separating strips are guided into the grooves of the display board.

In FIG. 5, the composing unit with seven magnetically activated pins for setting the seven lines of display elements (in a $5 \times 7$ matrix display) is located to the right of the right-hand transport roller assembly. In this location space requirements cause the fewest problems. Alternatives, such as positioning the composing unit either in front of or behind the rear display surface, are so impractical and problematic from the standpoint of space requirements, that they can hardly be considered. There is, however, an alternative which is practical and suitable, namely, mounting the composing unit inside the rack and thus within the loop of the transport belt between the right-hand roller assembly and the beginning of the display surface. When choosing this alternative, however, the magnetically operated pins push in the opposite direct, from inside to outside the loop of the transport belt.

Figure 9:
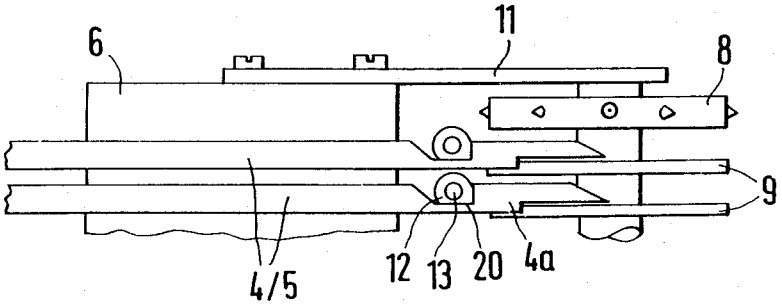
FIG. 9 shows a front view of a display unit in which the composing unit is mounted inside the loop of the transport belt.

FIG. 9 shows a front view of a section of the display unit rack in such a display unit without showing the transport belt. Recesses 20 are provided in separating strips 4 where pins 13 push from inside the display unit.

The upper edge of the recess is slightly higher than the lower edge of the display elements which are not shown here. A prerequisite for this arrangement, however, is that all display elements coming from the right and moving in the transport direction are situated behind part 4a of the separating strip. This can be achieved by means of springs pushing all display elements in front of the pointed ends into the grooves of the supporting disks. This embodiment has the disadvantage that also the vertical webs between the display elements can be touched by these springs and eventually be scratched. One embodiment of the present invention provides, as an alternative, an additional pin feed roller which pushes all display elements into the grooves of the supporting disks with its pins. This pin feed roller does not require its own drive, but can be advanced by means of sprockets on the other pin feed rollers and the transport roller assembly, since the punched out areas of the display elements can move the pin feed roller themselves. The necessary bearings may be located in a housing, not shown in this figure, to create a space between the roller assemblies for the removal or installation of the transport belt when the bearing bracket is adjusted.

If the magnetically activated pins require more space than provided considering the vertical spacing between the display elements, the magnetic pins may alternatively be moved around a display element in a horizontal direction. This, however, requires the data processing unit 25 activating the composing unit to restore the proper allocation by delaying the respective line data. This can be done according to generally known procedures. Furthermore, the display unit has to send a control pulse to the data processing unit 25 when the display elements have reached the setting position in which the magnetic pins should be activated, that is when the magnetic pins are approximately centered in front of the display elements. These control pulses can be generated by mounting a line scanner 26 either on a pin feed roller or on one of the supporting disks. This line scanner may be scanned 26 by a reflective photoelectric barrier and its lines are arranged in a way that the respective pulse is sent when the setting position has been reached.

There is another preferred alternative when the transport belt comprises a less flexible material. In this case, display elements are bent at their connection with the transport belt when they are punchd out, and therefore have tension which maintains them bent from the plane of the transport belt at an angle of about 30° to about 45°. A composing unit with pushing action is then no longer required and a different type of composing unit may be used which, depending on the characters to be displayed, moves the respective display elements into the plane of the transport belt, or which, yields to the tendency of the display element. Such a composing unit offers the advantage of working faster.

Figure 10:
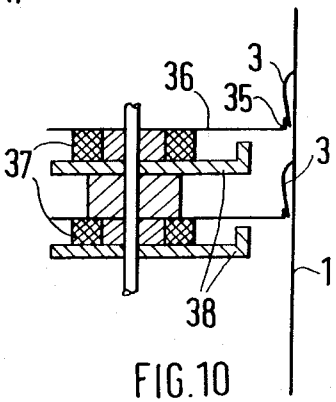
FIG. 10 shows a cross-sectional side view of another embodiment of a composing unit and display element according to the present invention.

FIG. 10 shows a cross-sectional side view of such a composing unit for two lines of the display unit. The preferred location within the display unit for this type of composing unit is the same as shown in FIG. 9. It may also be provided in the area of the transport roller assembly in a slightly modified form. Tongue 35 shown in FIG. 10, corresponds to the upper edge of recesses 20 shown in FIG. 9. FIG. 10 shows that due to its inner tension, display element 3 is bent out of the plane of transport belt 1, even if tongue 35 of spring 36 prevents it from further bending out of this plane. When magnetic winding 37 is energized, spring element 36 and tongue 35 are pulled down by the magnetic antipole 38, thus releasing the diplay element. It now bends at an angle of approximately 30° towards the left and will be located behind separating strip 4 following conveyance in the moving direction. The separating strip is not shown in this cross-sectional view. If the display element is not released by tongue 35, it will remain in front of separating strip 4. The preferred type of composing unit depends largely on the material of the transport belt. For smaller display units the latter type of composing unit is preferred, and for larger display units, the first described composing unit is preferred.

In some cases, it may be desirable to punch out the display elements in a way that some display elements are connected with the transport belt at the top, and some are connected with the transport belt at the bottom. This is recommended for smaller but rather long display units where the possibility exists that the transport belt may be pushed up due to its low weight and the thrust of the set display elements. In this embodiment, a guide in the opposite direction is necessary. If the display elements in the upper five lines of a ten line display point down, and those in the lower five lines point up, the transport belt preferably has a guide on both sides, even over a long distance.

The descriptions of the above mentioned embodiments assumed that the Latin script of European languages is used. If Arabic or Hebrew script, which reads from right to left, is to be used, the transport belt must be moved in the opposite direction, from left to right, for a running message display. The composing unit must then be installed at the left transport roller assembly.

If a vertical (Latin) running message display is to be used, the transport belt is oriented and conveyed from bottom to top. The composing unit is located at the lower roller assembly in this case.

In special cases, the display unit can even operate without transport rollers and a continuous looped transport belt. If, for instance, only a few characters representing, for example, a number are to be displayed, the transport belt may be mounted on a frame which is itself moved back and forth.

There may also be special cases where the transport belt is a continuous loop and traverses a square configuration over four transport rollers. The display unit can then be read from each of four directions.

To facilitate replacement of the transport belt it is recommended to move the bearing brackets, when are part of the roller assembly, back and forth by means of two eccentric disks which are mounted on a common shaft. By rotating this shaft, both bearing brackets can be moved and maintained parallel at the top and the bottom, thus tensioning the transport belt until it is smooth. This can even be done from just one side, such as the top. Both bearing brackets are then locked in their position by fastening the eccentric roller.

I claim:

1. Matrix type display unit comprising a transport belt providing a display surface on which characters, symbols or pictures are formed, said transport belt comprising a plurality of graphic display elements arranged in lines and columns; a composing unit controlled by a data processing unit capable of displacing said display elements out of the plane of said transport belt; and a plurality of separating strips corresponding to and aligned with said lines of said display elements, wherein said display elements (3) comprise a part of said transport belt (1) and are connected with said transport belt (1) along a portion of their perimeter and said transport belt (1) with said display elements (3) has a contrasting color in relation to said separating strips (4), whereby said display elements displaced by said composing unit are maintained in an invisible position behind said separating strips, and said display elements not displaced by said composing unit are maintained in a visible position in front of said separating strips.

2. Display unit as set forth in claim 1, wherein said transport belt (1) is a continuous loop traversing two transport roller assemblies (7) positioned at a distance from one another; at least one of said transport roller assemblies (7) is motor driven; said transport belt (1) is provided with pin feed holes (2) and each said transport roller assembly (7) comprises two pin feed rollers (8) engaging in said feed holes (2) of said transport belt (1) and a plurality of supporting disks (9) supporting said transport belt (1) between said display elements (3).

3. Display unit as set forth in claim 2, wherein said composing unit is located in the area of said transport roller asssembly (7); said separating strips (4) on a front display surface engage between said supporting disks (9) of said transport roller assembly (7), and a guide (15) is provided in the area of said composing unit to position all said display elements in an initial position parallel to the plane of said transport belt prior to said display elements passing said composing unit; and the upper edges of said supporting disks (9) are slightly higher than the lower edges of said display elements (3), whereby said display elements are maintained in front of said supporting disks when not displaced by said composing unit and said display elements are maintained at an angle behind the upper edges of said supporting disks (9) when displaced by said composing unit.

4. Display unit as set forth in claim 3, wherein said separating strips (4) are provided at the front and back sides of said roller assemblies and said separating strips at said front connect with said separating strips at said back by means of strips bent in a semi-circle around said roller assembly and located between said supporting disks (9) of said transport roller assembly (7) directly behind said transport belt (1).

5. Display unit as set forth in claim 2, wherein said composing unit is located within said continuous loop of said transport belt and displaces said display elements outwardly; and said separating strips (4) have a recessed upper edge in the area of said composing unit which enables said composing unit to displace said display elements (3) over said recessed upper edge of said separating strips; and a second pin feed roller is provided in the area of said composing unit to align all said display elements in an interior initial position prior to said display elements passing said composing unit.

6. Dislay unit as set forth in claim 2, wherein said display elements (3) are bent from the plane of said transport belt (1) at an angle of approximately 30° to 45°; and said composing unit comprises a plurality of magnetically activated spring elements having tongues on their terminal ends; whereby said tongues of said spring elements bear against said display elements to maintain them in said visible postion and release said display elements to provide them in said invisible position in response to input from said data processing unit.

7. Display unit as set forth in claim 2, wherein said separating strips (4) are provided at the front and back sides of said roller assemblies and said separating strips at said front connect with said separating strips at said back by means of strips bent in a semi-circle around said roller assembly and located between said supporting disks (9) of said transport roller assembly (7) directly behind said transport belt (1).

8. Display unit as set forth in claim 2, wherein a line scanner is provided at one of said transport roller assemblies (7) and connected with said data processing unit to signal said data processing unit when said display elements (3) are centered in front of said composing unit.

9. Display unit as set forth in claim 1, wherein said separating strips (4) in area of said display surface are U-shaped channels (5).

10. Display unit as set forth in claim 1, wherein a display board having a plurality of grooves (16) corresponding to said display elements is provided and said separating strips are formed by surfaces of said display board between said grooves.

11. Display unit as set forth in claim 10, wherein said display board comprises a transparent material which diffuses light, and a light source is provided behind said transport element.

* * * * *